United States Patent [19]

Tschopp

[11] 4,268,592

[45] May 19, 1981

[54] MATERIAL FOR COLOR PHOTOGRAPHY

[75] Inventor: Paul Tschopp, Düdingen, Switzerland

[73] Assignee: Ciba-Geigy AG, Basel, Switzerland

[21] Appl. No.: 70,475

[22] Filed: Aug. 28, 1979

[30] Foreign Application Priority Data

Sep. 7, 1978 [CH] Switzerland ..... 9408/78

[51] Int. Cl.[3] ..... G03C 7/00

[52] U.S. Cl. ..... 430/17; 430/386; 430/387; 430/554; 430/555; 430/558

[58] Field of Search ..... 430/554, 555, 558, 17, 430/386, 387

[56] References Cited

U.S. PATENT DOCUMENTS

| | | | |
|---|---|---|---|
| 2,619,419 | 11/1952 | Jennen | 430/555 |
| 3,615,506 | 10/1971 | Abbott et al. | 430/554 |
| 3,684,514 | 8/1972 | Iwama et al. | 430/554 |
| 3,930,866 | 1/1976 | Oishi et al. | 430/554 |
| 4,070,191 | 1/1978 | Imamura et al. | 430/562 |

*Primary Examiner*—J. Travis Brown

*Attorney, Agent, or Firm*—Sprung, Felfe, Horn, Lynch & Kramer

[57] ABSTRACT

Light-sensitive recording material for color photography, which contains, in at least one silver halide emulsion layer, at least one magenta coupler of the formula

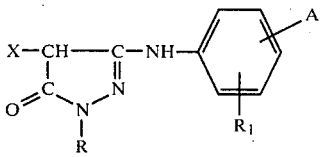

in which A is a 5-membered, heterocyclic, unsaturated ring system which contains 2 or 3 hetero-atoms, at least one of which is a nitrogen atom, and can be fused with a benzene ring and which is substituted by at least one ballast group, R is a substituted or unsubstituted aryl radical, $R_1$ is hydrogen, halogen, alkyl, alkoxy, halogenoalkyl, alkylsulfonyl or aryloxy and X is a radical detachable during the coupling reaction.

The magenta couplers show high reactivity (high maximum density), which facilitates accelerated processing of the photographic materials, and minimal fogging. The couplers also have good fastness to light.

18 Claims, No Drawings

MATERIAL FOR COLOR PHOTOGRAPHY

In order to produce coloured photographic images, exposed silver halide emulsion layers, which at the same time contain colour couplers are, as is known, developed with a developer substance which contains aromatic primary amino groups. The oxidised developer substance reacts with the colour coupler with the formation of an image dye, the amount of the latter depending on the amount of silver developed.

In general, a light-sensitive photographic multi-layer material is used which consists of a red-sensitive layer, which contains the cyan coupler, a green-sensitive layer, which contains the magenta coupler, and a blue-sensitive layer, which, in turn, contains the yellow coupler. On colour developing, the corresponding dyes having the colours cyan, magenta and yellow then form. Usually, phenols or α-naphthols are employed as cyan couplers, pyrazolones are employed as magenta couplers and acylacetylamides are employed as yellow couplers. The dyes formed after developing are then indophenols, indamines or azomethines.

Characteristics demanded of colour couplers which are incorporated in photographic materials are, in particular, the following: good fastness to diffusion, i.e. no diffusion into adjacent layers. Good solubility in water or, in particular, in water-immiscible, high-boiling organic solvents, for example tricresyl phosphate or dibutyl phthalate. Suitable absorption range and high fastness to light (no yellowing) of the dyes formed from the couplers. High reactivity of the couplers during colour formation.

Known photographic magenta couplers (such as are described, for example, in German Auslegeschriften Nos. 1,116,533, 1,116,534 and 1,135,757, U.S. Pat. No. 3,183,095 and British Pat. No. 577,804) have only some of these characteristics. Thus, for example, although the dyes which are obtained, after colour developing, from the 3-anilinopyrazolone derivatives generally used as magenta couplers for chromogenic photographic materials are distinguished by high fastness to light and good stability on prolonged storage, the dyes have, however, a relatively short-wave maximum absorption ($\lambda_{max}$ < 540 nm) and this is a disadvantage for accurate colour rendition. It is, therefore, the object of the present invention to provide novel magenta couplers which, by reason of their reactivity, facilitate accelerated processing of the photographic materials, colour developing, on the one hand, not being disturbed by the formation of colour fogs and, on the other hand, colour rendering being improved. The object is achieved according to the invention by the use of magenta couplers which contain a heterocyclic radical as a ballast group.

The present invention relates to a light-sensitive recording material for colour photography, which contains at least one magenta coupler in at least one silver halide emulsion layer, wherein the magenta coupler has the formula

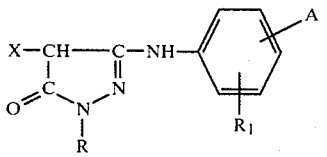

(1)

in which A is a 5-membered, heterocyclic, unsaturated ring system which contains 2 or 3 hetero-atoms, at least one of which is a nitrogen atom, and can be fused with a benzene ring and which is substituted by at least one ballast group, R is a substituted or unsubstituted aryl radical, $R_1$ is hydrogen, halogen, alkyl, alkoxy, halogenoalkyl, alkylsulfonyl or aryloxy and X is a radical detachable during the coupling reaction.

The invention also relates to a process for colour photography, for the production of a magenta image by colour developing an exposed recording material which contains a compound of the formula (1) as the magenta coupler, the resulting magenta images, the compounds of the formula (1), their preparation and the use of compounds of the formula (1) as magenta couplers in light-sensitive recording materials for colour photography. The colour couplers employed according to the invention can be either 2-equivalent couplers or 4-equivalent couplers, i.e. compounds which consume 2 or 4 equivalents of silver halide per molecule on colour formation with the oxidised developer.

Suitable substituents R in the compounds of the formula (1) are unsubstituted or mono- or poly-substituted aryl radicals, preferably phenyl radicals.

Substituents can be: halogen, especially chlorine and bromine, and alkyl or alkoxy each having 1 to 5 carbon atoms, for example methyl, ethyl, propyl, i-propyl, butyl, tert.-butyl, amyl, methoxy, ethoxy, propoxy, butoxy and pentoxy, it being possible for the alkyl and alkoxy radicals to contain further substituents if desired, for example halogen, hydroxyl, cyano or nitro; further substituents on the phenyl radical are also: phenyl, trifluoromethyl, cyano, nitro, alkylsulfonyl and phenylsulfonyl, the latter being unsubstituted or substituted by halogen, hydroxyl, cyano or trifluoromethyl or alkyl ($C_1$–$C_4$), and also unsubstituted or N- or N,N-substituted sulfonamide (—$SO_2NRR'$), in which the substituents (R, R') are alkyl or substituted or unsubstituted phenyl. Specific radicals R are the following: 2-chlorophenyl, 2-bromophenyl, 2,6-dichlorophenyl, 2,4,6-trichlorophenyl, 3,5-dibromophenyl, 4-chlorophenyl, 4-cyanophenyl, 2-cyanophenyl, 4-nitrophenyl, 3-nitrophenyl, 4-methylphenyl, 2,6-dimethylphenyl, 4-butylphenyl, 4-trifluoromethylphenyl, 2-trifluoromethylphenyl, 2-ethoxyphenyl, 2-butoxyphenyl, N,N-diphenylsulfonamidophenyl, N,N-dibutylsulfonamidophenyl, 2-methyl-5-nitrophenyl, 2-chloro-5-cyanophenyl, 5-chloro-2-methylphenyl, 2,6-dichloro-4-methoxyphenyl, 2,4-dichloro-6-methylphenyl, 2,6-dichloro-4-nitrophenyl or 2-chloro-4,6-dimethylphenyl.

In addition to hydrogen, the substituent $R_1$ in the compounds of the formula (1) is in particular halogen, for example fluorine, chlorine or bromine, or also alkyl, alkoxy, halogenoalkyl or alkylsulfonyl, these radicals preferably containing 1 to 5 carbon atoms. Thus, alkyl $R_1$ can be methyl, ethyl, propyl, butyl and amyl or also the corresponding branched-chain radicals. For the other substituents which contain an alkyl or alkoxy moiety, alkyl is, analogously, one of the radicals defined. The substituent $R_1$ is preferably halogen, especially chlorine, which is located in the o-position relative to the —NH— group.

The substituent A in the compounds of the formula (1) is a 5-membered, heterocyclic, unsaturated ring system which contains 2 or 3 hetero-atoms, at least one of which is a nitrogen atom, and can be fused with a benzene ring and which is substituted by at least one ballast group. The ring of this heterocyclic ring system can contain, for example, 2 or 3 nitrogen atoms or also 1 nitrogen atom and one oxygen atom, 1 nitrogen atom and 1 sulfur atom, 2 nitrogen atoms and 1 oxygen atom or 2 nitrogen atoms and 1 sulfur atom. Specific ring systems are the following: diazole, triazole, oxazole, thiazole, oxadiazole, thiadiazole, diazolone, triazolone, benzoxazole, benzthiazole or benzimidazole. They can be linked to the adjacent phenyl ring via a carbon atom or via a nitrogen atom.

The heterocyclic ring systems (substituent A) are substituted by at least one conventional ballast group. Examples of such ballast groups are straight-chain or branched alkyl radicals having 5 to 40 carbon atoms. Straight-chain alkyl radicals can thus be, for example: pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, triacontyl, hentriacontyl, dotriacontyl, tritriacontyl, tetratriacontyl, pentatriacontyl, hexatriacontyl, heptatriacontyl, octatriacontyl, nonatriacontyl and tetracontyl. The isomers of these radicals are likewise suitable.

Furthermore, the radicals listed below, in which the sum of the carbon atoms in each case should likewise be in the range from 5 to 40, are also suitable as ballast groups: alkoxy, cycloalkoxy, alkoxyalkyl, for example $CH_3(CH_2)_4$—$OCH_2$— or $CH_3O(CH_2)_5$— and homologues, alkoxycycloalkyl, for example $CH_3O(cyc)C_5H_8$ and homologues, cycloalkoxyalkyl, for example

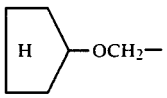

and homologues, aralkyl, for example benzyl, phenoxyalkyl, for example

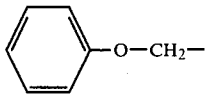

and homologues, which can be substituted by halogen (F, Cl or Br) or alkyl ($C_1$–$C_{10}$), alkyl- and dialkylaminoalkyl, for example $CH_3NH(CH_2)_9$—,

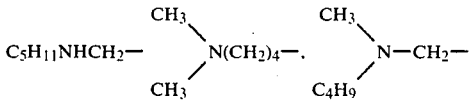

and the corresponding homologues, aryl- and diarylaminoalkyl, for example

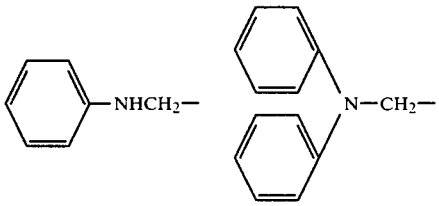

and homologues, which can be substituted in the aryl moiety by halogen (F, Cl or Br) or alkyl or alkoxy ($C_1$–$C_4$), alkylmercaptoalkyl and arylmercaptoalkyl, for example

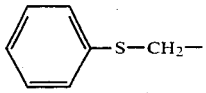

and homologues, which can be substituted as indicated for aryl- and diaryl-aminoalkyl.

Further ballast groups can be indicated by the following formulae: —$COOR_{13}$, —$COR_{13}$, —$NR_{13}R_{14}$, —$CONR_{13}R_{14}$, —$NR_{14}COR_{13}$, —$NR_{14}COR_{15}$, —$SO_2R_{13}$, —$SO_2NR_{13}R_{14}$ or —$NR_{14}SO_2R_{13}$, in which $R_{13}$ is alkyl having 5 to 40 carbon atoms or cycloalkyl having 5 to 12 carbon atoms, $R_{14}$ is hydrogen or alkyl having 1 to 12 carbon atoms and $R_{15}$ is alkoxyalkyl having 5 to 20 carbon atoms or phenoxyalkyl which has 1 to 12 carbon atoms in the alkyl moiety and can be substituted on the phenyl ring by alkyl having 1 to 10 carbon atoms.

Examples of alkyl are those already given above. Cycloalkyl having 5 to 12 carbon atoms is, for example, cyclopentyl, cyclooctyl or cyclododecyl and especially cyclohexyl, which, in turn, can be substituted by alkyl. The alkyl groups can contain 1 to 4 carbon atoms (methyl, ethyl, propyl, isopropyl, butyl, isobutyl or tert.-butyl) and there can be one or more, for example two, alkyl substituents on cyclohexyl.

The alkyl substituents ($R_{14}$) having 1 to 12 carbon atoms can be, for example, methyl, ethyl, propyl, butyl, pentyl, hexyl, heptyl, octyl, nonyl, decyl, undecyl or dodecyl or the corresponding isomers (branched alkyl).

What has been stated above applies in respect of alkoxyalkyl and phenoxyalkyl.

In addition to the ballast group, the heterocyclic ring systems (substituent A) can also contain further substituents, for example alkyl, alkoxy, hydroxyalkyl, halogenoalkyl (for example trifluoromethyl) or alkylmercapto, each having 1 to 4 carbon atoms, and also halogen (fluorine, chlorine or bromine), hydroxyl, carbalkoxy having 1 to 4 carbon atoms in the alkoxy moiety, —COOH, —CN, —$CONH_2$ and/or —$NHCOR_{12}$, in which $R_{12}$ is alkyl having 1 to 4 carbon atoms or alkoxyalkyl having 2 to 4 carbon atoms.

The substituents X in the compounds of the formula (1) are customary radicals present in the 4-position of 5-pyrazolone magenta couplers, for example hydrogen, halogen, especially fluorine, chlorine or bromine, and also cyano and thiocyano as well as arylazo, aryloxy, acyloxy, acylamino or a monothio radical; the latter can be, for example, an alkylmonothio, cycloalkylmonothio, substituted or unsubstituted arylmonothio or substituted or unsubstituted heterocyclic monothio radical.

Is X arylazo then it can be a phenylazo or naphthylazo radical, which can be substituted by alkyl or alkoxy, each having 1 to 5 carbon atoms, halogen, especially fluorine, chlorine or bromine, alkylmercapto or acylamino having 1 to 7 carbon atoms (derived from alkyl- or aryl-carboxylic acids). Preferred alkylmercapto is methylmercapto. Examples of arylazo radicals are: phenylazo, tolylazo, chlorophenylazo, benzamidophenylazo, methylmercaptophenylazo, acetamidophenylazo, methoxyphenylazo or naphthylazo. Is X aryloxy then it can be, for example, a phenoxy or naphthoxy radical. Magenta couplers of the formula (1) in which X is an arylazo radical are also suitable, in particular, as masking couplers in (chromogenic) recording materials for colour photography. Is X acyloxy then it preferably has 1 to 22 carbon atoms and is, for example, an acetoxy, 3-pentadecylphenoxyacetoxy, propionyloxy, hexanoyloxy, decanoyloxy, octadecanoyloxy or 3-phenylpropionyloxy radical.

Radicals employed as X for acylamino can be those which are derived from aliphatic or aromatic carboxylic acids and preferably contain 1 to 22 carbon atoms. Is X a monothio radical then it can be for example, alkylthio having preferably 5 to 10 carbon atoms, such as phenylthio, hexylthio, heptylthio, octylthio, nonylthio or decylthio and the corresponding isomers.

Examples of arylthio are phenyl- or naphthyl-thio, which can be substituted or unsubstituted; cycloalkylthio radicals preferably contain 5 or 6 ring carbon atoms, whilst the heterocyclic monothio radicals are in particular those which contain 5 or 6 atoms in the ring, at least one of these atoms being a nitrogen, oxygen or sulfur atom but preferably 1 to 4 of the said atoms being nitrogen atoms.

The heterocyclic radicals can contain, for example, tetrazolyl, triazinyl, triazolyl, imidazolyl, oxazolyl, oxadiazolyl, diazolyl, thiazolyl, thiadiazolyl, benzoxazolyl, benzothiazolyl, pyrimidyl, pyridinyl, quinolinyl or benzimidazolyl rings.

They can be unsubstituted or substituted by conventional substituents, for example by halogen, such as chlorine, bromine, iodine and/or fluorine, phenyl, amino, nitro, alkyl, alkylcarboxamido or alkylsulfonamido, these radicals as a rule being short-chain, i.e. containing 1 to 5 carbon atoms.

Typical heterocyclic monothio radicals are, for example, 2-benzothiazolylthio, 1-phenyl-5-tetrazolylthio, 1-(4-carbomethoxyphenyl)-5-tetrazolylthio, 5-phenyl-1,3,4-oxadiazolyl-2-thio, 2-phenyl-5-(1,3,4)-oxadiazolylthio, 2-benzoxazolylthio or 2-benzimidazolylthio radicals.

A preferred recording material for photography is that which contains at least one magenta coupler of the formula

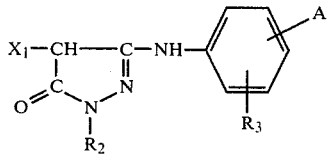

(2)

in which $R_2$ is phenyl, which is unsubstituted or substituted by halogen, substituted or unsubstituted alkyl or alkoxy, each having 1 to 5 carbon atoms, phenyl, trifluoromethyl, cyano, nitro, $—SO_2R_4$ or $—SO_2NR_5R_6$, $R_3$ is hydrogen, halogen, alkyl, halogenoalkyl, alkoxy or alkylsulfonyl, each having 1 to 5 carbon atoms, or phenoxy and $R_4$ is alkyl having 1 to 5 carbon atoms or substituted or unsubstituted phenyl, $R_5$ and $R_6$ are each hydrogen, alkyl having 1 to 5 carbon atoms or substituted or unsubstituted phenyl, $X_1$ is hydrogen, halogen, cyano, thiocyano, arylazo, aryloxy, acyloxy, acylamino or $R_7S$—, in which $R_7$ is alkyl having 5 to 10 carbon atoms, cycloalkyl having 5 or 6 carbon atoms, substituted or unsubstituted aryl or a substituted or unsubstituted heterocyclic radical, and A is as defined.

A particularly suitable recording material is, furthermore, that which contains at least one magenta coupler of the formula

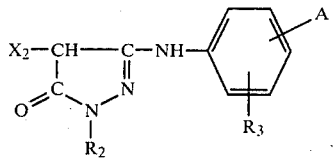

(3)

in which $X_2$ is hydrogen, halogen, cyano, thiocyano, phenylazo or naphthylazo which are unsubstituted or substituted by alkyl or alkoxy, each having 1 to 5 carbon atoms, halogen, alkylmercapto or acylamino, each having 1 to 7 carbon atoms, acyloxy having 1 to 22 carbon atoms or $R_8S$— and $R_8$ is alkyl having 5 to 10 carbon atoms, cycloalkyl having 5 or 6 carbon atoms, phenyl, naphthyl or a substituted or unsubstituted 5-membered or 6-membered heterocyclic ring which contains at least one nitrogen, oxygen or sulfur atom and preferably contains 1 to 4 nitrogen atoms, and $R_2$, $R_3$ and A are as defined.

Preferred representatives of the magenta couplers of the formula (3) are those of the following formulae (4) and (5):

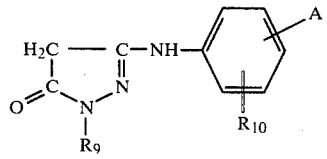

(4)

in which $R_9$ is phenyl which is unsubstituted or substituted by chlorine, methyl, methoxy, trifluoromethyl or cyano and $R_{10}$ is hydrogen, alkyl having 1 to 5 carbon atoms or halogen and A is as defined, and

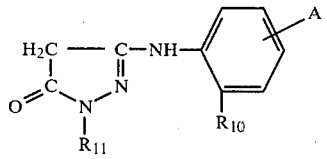

(5)

in which $R_{11}$ is 2,4,6-trichloro- or 2,6-dichloro-4-methoxy-phenyl and A and $R_{10}$ are as defined.

Photographic recording materials which are likewise preferred are those which contain at least one magenta coupler of the formula

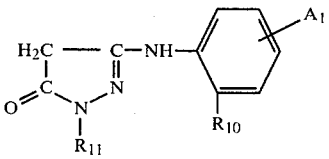

(6)

in which $A_1$ is a 5-membered, heterocyclic, unsaturated ring system which contains 2 or 3 nitrogen atoms or 1 or 2 nitrogen atoms and one oxygen atom or one sulfur atom and can be fused with a benzene ring and which is substituted by at least one ballast group and $R_{10}$ and $R_{11}$ are as defined, or of the formula

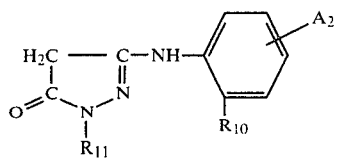

(7)

in which $A_2$ is a diazole, triazole, oxazole, thiazole, oxadiazole, thiadiazole, diazolone, triazolone, benzoxazole, benzthiazole or benzimidazole radical with at least one ballast group and, if desired, further substituents, and $R_{10}$ and $R_{11}$ are as defined.

The further substituents in the radical $A_2$ in the formula (7) are preferably alkyl, alkoxy, hydroxyalkyl, halogenoalkyl or alkylmercapto, each having 1 to 4 carbon atoms, halogen, hydroxyl, carbalkoxy having 1 to 4 carbon atoms in the alkoxy moiety, —CN, —$CONH_2$ and/or —$NHCOR_{12}$, in which $R_{12}$ is alkyl having 1 to 4 carbon atoms, whilst the ballast group is alkyl, alkoxy, cycloalkoxy, alkoxyalkyl, alkoxycycloalkyl, cycloalkoxyalkyl, aralkyl, phenoxyalkyl, which can be substituted by halogen or alkyl having 1 to 10 carbon atoms, alkyl- or dialkyl-aminoalkyl, substituted or unsubstituted aryl- or diaryl-aminoalkyl, alkylmercaptoalkyl or substituted or unsubstituted arylmercaptoalkyl, in which, in each case, the sum of the carbon atoms is 5 to 40; or also —$COOR_{13}$, —$COR_{13}$, —$NR_{13}R_{14}$, —$CONR_{13}R_{14}$, —$NR_{14}COR_{13}$, —$NR_{14}COR_{15}$, —$SO_2R_{13}$, —$SO_2NR_{13}R_{14}$ or —$NR_{14}SO_2R_{13}$, in which $R_{13}$ is alkyl having 5 to 40 carbon atoms or cycloalkyl having 5 to 12 carbon atoms, $R_{14}$ is hydrogen or alkyl having 1 to 12 carbon atoms and $R_{15}$ is alkoxyalkyl having 5 to 20 carbon atoms or phenoxyalkyl which has 1 to 12 carbon atoms in the alkyl moiety and can be substituted on the phenyl ring by alkyl having 1 to 10 carbon atoms.

Preferred ballast groups (L) are indicated in the magenta coupler of the formula

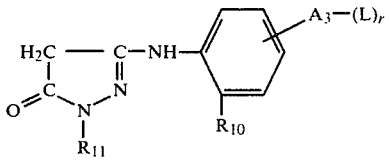

(8)

in which $A_3$ is a diazole, triazole, oxazole, thiazole, oxadiazole, thiadiazole, diazolone, triazolone, benzoxazole, benzthiazole or benzimidazole radical which is linked to the adjacent phenyl ring via a nitrogen or a carbon atom and can be substituted by alkyl, alkoxy, hydroxyalkyl, halogenoalkyl or alkylmercapto, each having 1 to 4 carbon atoms, halogen, amino, hydroxyl, carbalkoxy having 1 to 4 carbon atoms in the alkoxy moiety, —$CONH_2$, —CN and/or —$NHCOR_{12}$, in which $R_{12}$ is alkyl having 1 to 4 carbon atoms or alkoxyalkyl having 2 to 4 carbon atoms, L is alkyl, alkoxy, alkoxyalkyl, phenylalkyl or phenoxyalkyl having 5 to 30 carbon atoms, or —$NHCOR_{13}$ or —$NR_{14}COR_{15}$ in which $R_{13}$ is alkyl having 5 to 40 carbon atoms or cycloalkyl having 5 to 12 carbon atoms, $R_{14}$ is hydrogen or alkyl having 1 to 12 carbon atoms and $R_{15}$ is alkoxyalkyl having 5 to 20 carbon atoms or phenoxyalkyl which has 1 to 22 and preferably 1 to 14 or 1 to 12 carbon atoms in the alkyl moiety and can be substituted on the phenyl ring by alkyl having 1 to 10 carbon atoms, and r is 1 or 2 and $R_{10}$ and $R_{11}$ are as defined.

Preferred magenta couplers of the formula (9) are those in which $A_3$ is a benzoxazole or benzthiazole radical or especially a benzimidazole radical or, in particular, a thiadiazole radical and which are indicated in the formulae (9) to (12) given below:

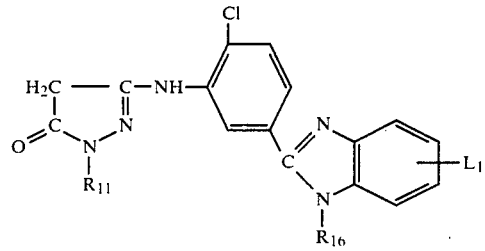

(9)

in which $R_{16}$ is hydrogen or alkyl or halogenoalkyl each having 1 to 4 carbon atoms and $L_1$ is alkyl, alkoxyalkyl, phenylalkyl or phenoxyalkyl having 8 to 30 carbon atoms and $R_{11}$ is as defined;

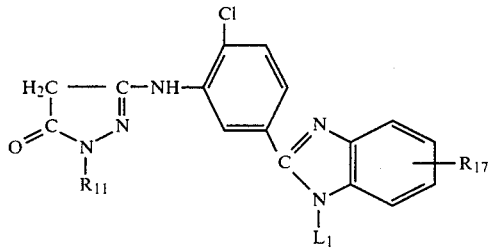

(10)

in which $R_{17}$ is hydrogen or alkyl, alkoxy or halogenoalkyl each having 1 to 4 carbon atoms, halogen, amino, hydroxyl, cyano, —$CONH_2$ and/or carbalkoxy having 1 to 4 carbon atoms in the alkoxy moiety and $L_1$ is alkyl, alkoxyalkyl, phenylalkyl or phenoxyalkyl having 8 to 30 carbon atoms, and

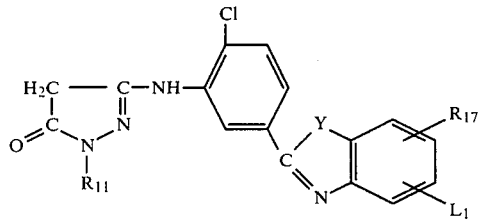

(11)

in which Y is —O— or —S— and $R_{11}$, $R_{17}$ and $L_1$ are as defined, and

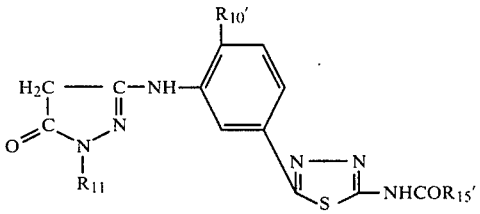

(12)

in which $R_{10}'$ is halogen, especially chlorine, or alkyl having 1 to 5 carbon atoms, $R_{15}'$ is phenoxyalkyl which has 1 to 14 carbon atoms in the alkyl moiety and is substituted on the phenyl ring by alkyl having 1 to 10 carbon atoms, especially tert.-amyl, and $R_{11}$ is as defined.

$R_{11}$ is preferably 2,4,6-trichlorophenyl, $R_{17}$ is preferably hydrogen (and in formula 10 also $CF_3$) and $L_1$ is preferably alkyl having 8 to 25 and in particular 16 carbon atoms.

The magenta couplers of the formulae (1) to (12) can be prepared in accordance with the following reaction equation:

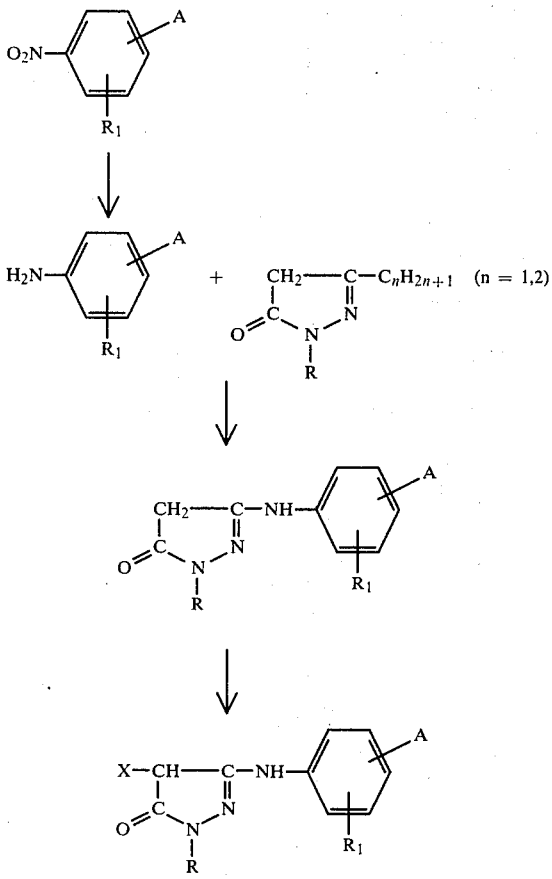

The heterocyclic compounds substituted by a nitrophenyl radical are prepared by known methods described in the literature. The preparation of such compounds is described, for example, in Chem. Ber. 26,427 (1893) and 93, 2,108 (1969), German Auslegeschrift No. 1,670,914 and British Pat. No. 970,480. Aminobenzimidazoles are prepared direct from substituted or unsubstituted N-(nitrobenzoyl)-2-nitroanilines by reduction and cyclisation in situ.

The reduction of the nitro compounds is generally effected with iron powder in ethanol in the presence of hydrochloric acid (Bechamp process).

The anilinopyrazolones are prepared by the method indicated in German Offenlegungsschrift No. 2,015,814, according to which 3-alkoxy-5-pyrazolones are heated with the substituted aniline in the presence of an acid catalyst.

The magenta couplers of the formulae (1) to (12) can also be prepared by a method indicated in German Offenlegungsschrift No. 2,636,118, in accordance with the following reaction equation:

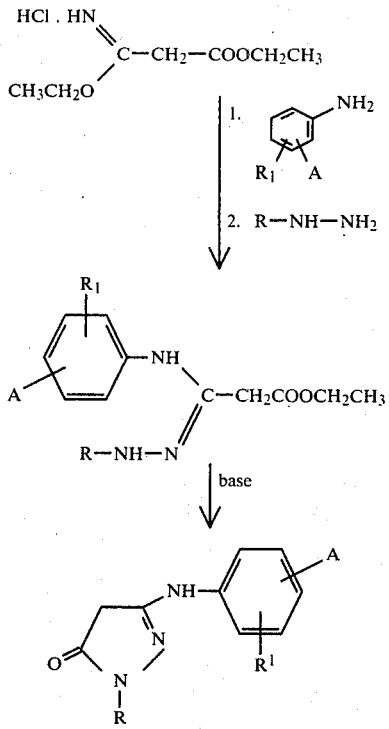

The choice of synthesis route depends, in particular, on the stability of the heterocyclic structure in the presence of acids or bases, and in some cases certain modifications to the processes indicated in the literature are necessary.

The following compounds are examples of aniline derivatives which are substituted by a heterocyclic radical and are suitable within the framework of the present invention:

1. 6-n-Dodecyl-2-(4'-aminophenyl)-benzthiazole
2. 2-(3'-Aminophenyl)-5-myristylamino-benzoxazole
3. 2-(3'-Amino-4'-chloro-phenyl)-5-stearylamino-benzoxazole
4. 3-(4'-Aminophenyl)-4-dodecyl-1-methyl-1,2,4-triazolone
5. 3-Hexadecyl-5-(3'-amino-4'-methyl-phenyl)-1,2,4-oxadiazole
6. 1-(4'-Aminophenyl)-3-decyl-1,2,4-triazole
7. 3-(3'-Amino-4'-methyl-phenyl)-1-ethyl-4-hexyl-1,2,4-triazol-5-one
8. 3-Dodecyl-5-(4'-aminophenyl)-1,2,4-oxadiazole
9. 2-(3'-Amino-4'-chloro-phenyl)-3-dodecyl-4,5-dimethylimidazole
10. 2-(4'-Aminophenyl)-4-dodecyl-thiazole
11. 1-(4'-Amino-3'-methoxy-phenyl)-3-octyl-1,2,4-triazole
12. 5-(4'-Aminophenyl)-3-[α-(3'-t-butyl-4'-hydroxyphenoxy)-butyramino]-1,3,4-thiadiazole
13. 2-(3'-Aminophenyl)-4-tetradecyl-thiazole
14. 5-(3'-Amino-4'-methyl-phenyl)-3-stearylamino-1,3,4-thiadiazole
15. 1-Hexadecyl-2-(3'-amino-4'-chloro-phenyl)-benzimidazole
16. 1-Decyl-2-(4'-aminophenyl)-benzimidazole
17. 1-Dodecyl-6-trifluoromethyl-2-(3'-amino-4'-chlorophenyl)-benzimidazole
18. 6-Ethoxy-1-octyl-2-(3'-amino-4'-methyl-phenyl)-benzimidazole 19. 1-Hexadecyl-6-methylsulfonyl-2-(3'-amino-4'-methoxyphenyl)-benzimidazole.

The phenylhydrazines used to synthesise the magenta couplers of the formula (1) are obtained by generally known methods. Usually, they are obtained by reduction of the corresponding diazonium salts. The following are examples of phenylhydrazines which are particularly suitable within the framework of the present invention:

1. 2,4,6-Trichloro-phenylhydrazine
2. Phenylhydrazine
3. 2,6-Dichloro-4-methyl-phenylhydrazine
4. 3-Methoxy-4-methyl-phenylhydrazine
5. 4-Methylsulfonyl-phenylhydrazine
6. 2-Bromo-4,6-dimethyl-phenylhydrazine
7. 2,4-Dichloro-6-methoxy-phenylhydrazine
8. 3-Trifluoromethyl-phenylhydrazine
9. 4-Phenyl-phenylhydrazine
10. 4-Cyano-phenylhydrazine
11. 2-Chloro-4-cyano-phenylhydrazine
12. 2-Chloro-4-methoxy-6-methyl-phenylhydrazine
13. 2,4,6-Trimethyl-phenylhydrazine
14. 2,6-Dichloro-4-methoxy-phenylhydrazine
15. 3,4-Dichloro-phenylhydrazine
16. 4-(N,N-Diethylaminosulfonyl)-phenylhydrazine The magenta couplers according to the invention are a category of compounds which is novel per se. They are distinguished by high reactivity (high maximum density), which facilitates accelerated processing of the photographic materials, and minimal fogging. The couplers also have good fastness to light. In addition, the magenta-coloured dyes which are formed from the couplers by colour developing have excellent fastness to light, moisture and heat, possess a maximum absorption in the desired longer-wave spectral region and also a distinctly reduced secondary absorption in the blue spectral region and thus give a colour shade which is exceptionally advantageous for colour reproduction.

The colour couplers of the formulae (1) to (11), which are also a subject of the present invention, can be incorporated in a known manner in photographic layers, for example in silver halide emulsions containing gelatine and/or other binders.

For example, they can be used in silver bromide, silver chloride or silver iodide emulsions or in those emulsions which contain a mixture of silver halides, such as silver bromide/iodide or silver chloride/bromide emulsions.

The emulsions can be chemically sensitised and they can also contain customary organic stabilisers and antifogging agents as well as customary plasticisers, for example glycerine. The emulsions can also be hardened with the hardeners customary for gelatine. Furthermore, the emulsions can contain customary coating assistants. The emulsions can be applied to layer supports customary for photographic recording material. If desired, a mixture of several colloids can be used to disperse the silver halides.

The customary developer baths can be employed for developing the recording material for colour photography. These baths as a rule contain a developer substance of the p-phenylenediamine type, a development retarder, such as potassium bromide, an antioxidant, such as sodium sulfite, and a base, for example an alkali metal hydroxide or alkali metal carbonate. Furthermore, the developer baths can contain a conventional antifogging agent and complexing agents.

Corresponding application possibilities are described, for example, in U.S. Pat. Nos. 2,304,939, 2,304,940, 2,322,027, 2,284,879, 2,801,170, 2,801,171, 2,749,360 and 2,825,382.

In the following Examples parts and percentages are by weight.

EXAMPLE 1

A solution of 1.7 g of 3-ethoxy-1-(2',4',6'-trichlorophenyl)-pyrazolin-5-one, 1.9 g of 2-(4'-chloro-3'-aminophenyl)-1-n-hexadecylbenzimidazole and 0.15 g of methanesulfonic acid in 20 ml of o-dichlorobenzene is heated at 160° C. for 20 hours.

After cooling the reaction mixture, the latter is evaporated to dryness. The resulting residue is taken up in benzene/ethyl acetate and purified by chromatography through a column containing silica gel. The coupler of the formula

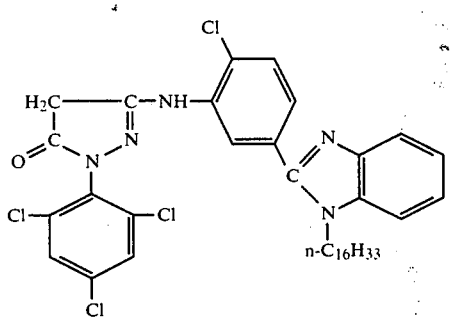

(101)

is obtained in the form of a pale yellow powder with a melting point of 152° to 156° C.

The coupler of the formula

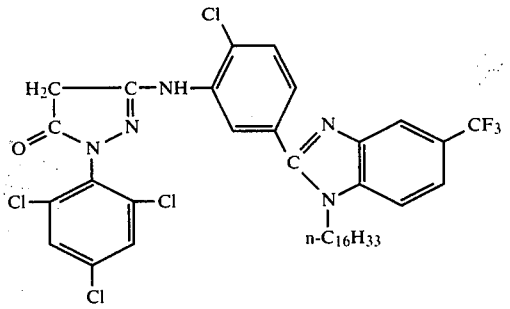

(102)

Melting point: 185° to 187° C.
is also obtained analogously.

EXAMPLE 2

2.32 g of 2-[2'-(4''-t-pentylphenoxy)]-myristoylamino-5-(3'-amino-4'-methyl)-1,3,4-thiadiazole and 1.75 g of ethyl β-ethoxy-β-imino-propionate hydrochloride in a mixture of 15 ml of absolute methanol and 1.5 ml of absolute toluene are first stirred for 15 hours at room temperature and then stirred under reflux for 3 hours. 0.83 g of 2,4,6-trichlorophenylhydrazine is then added and the mixture is stirred under reflux for a further 21 hours, 0.23 g of sodium methylate is added and the resulting mixture is heated at the reflux temperature for a further 1 hour. It is then evaporated to dryness and the residue is purified by preparative chromatography on thin layer plates (stationary phase silica gel, mobile phase petroleum ether/ethyl acetate, 6:4).

This gives the coupler of the formula

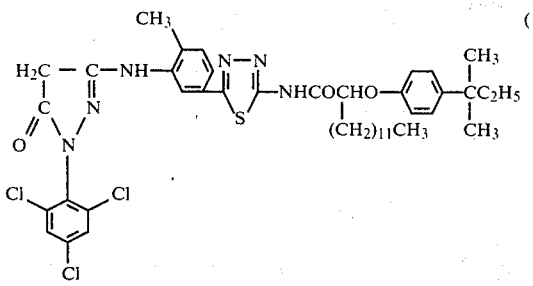

(103)

with a melting point of 93° to 96° C.

The coupler of the formula

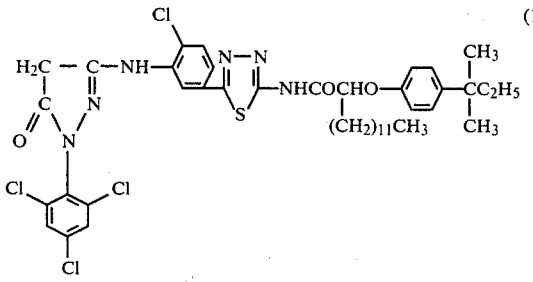

(104)

Melting point: 135°-137° C.
is also obtained analogously.

EXAMPLE 3

0.1 mmol of each of the magenta couplers of the formulae (101) to (104) is dissolved in 2.0 ml of tricresyl phosphate/methylene chloride (1:9). The methylene chloride is evaporated off, 2.0 ml of an 8% aqueous solution of sodium isopropylnaphthalenesulfonate, 6.6 ml of 6% gelatine solution and 1.2 ml of water are added, the pH of the mixture is adjusted to 6.5 and the mixture is emulsified for 5 minutes with the aid of an ultrasonic device with an output of 100 watts.

2.5 ml of the coupler emulsion, freshly exposed to ultrasonic waves, X.0.4 ml of silver bromide emulsion, where X is the number of stoichiometric equivalents of silver per mol of coupler, with a pH of 6.5 and containing 1.4% of silver and 6.0% of gelatine, 1.0 ml of a 1% aqueous solution of the hardener of the formula

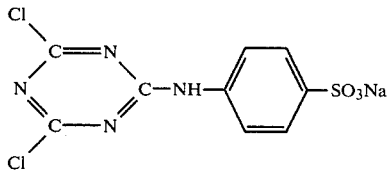

and 5.0 ml of water are mixed together and coated, at 40° C., onto a subbed 13 cm×18 cm glass plate.

After the mixture has solidified at 10° C., the plate is dried in a circulating air drying cabinet at room temperature.

A strip cut to 4.0 cm×6.5 cm is exposed, at 500 Lux, under a step wedge for 2 seconds and then treated at 24° C. as follows:

| | Minutes |
|---|---|
| 1. Colour development | 5 |

-continued

| | Minutes |
|---|---|
| 2. Washing | 5 |
| 3. First fixing | 2 |
| 4. Washing | 2 |
| 5. Silver bleaching | 4 |
| 6. Washing | 2 |
| 7. Second fixing | 4 |
| 8. Washing | 10 |
| 9. Drying | 10 |

A colour developer of the following composition is used for processing:

| | |
|---|---|
| 4-Amino-3-methyl-N-ethyl-N-[β-(methylsulfonamido)-ethyl]-aniline . $1\frac{1}{2}H_2SO_4$ . $H_2O$ | 10 mmols/l |
| Anhydrous sodium sulfite | 2.0 g/l |
| Potassium bromide | 0.5 g/l |
| Potassium carbonate | 40.0 g/l |
| Benzyl alcohol | 10.0 ml/l |
| (pH: 10.7) | |

Conventional baths are used for fixing and silver bleaching.

The maximum density and the absorption maximum of the step wedge thus obtained are measured. The values given in Table 1 are obtained.

TABLE 1

| Coupler No. | $\lambda_{max}$ | $D_{max}$ |
|---|---|---|
| 101 | 541 nm | 1.18 |
| 102 | 540 nm | 1.54 |
| 103 | 538 nm | 1.53 |
| 104 | 538 nm | 1.08 |
| Comparison coupler (105) | 537 nm | 0.99 |

Formula of the comparison coupler (Research Disclosure 14,436 (1976)):

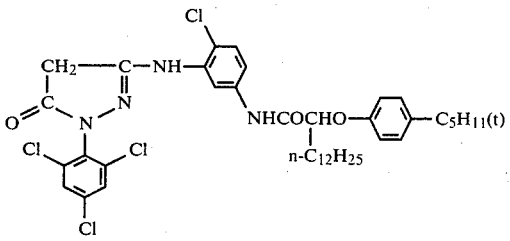

(105)

The data in Table 1 show that the couplers according to the invention have a higher maximum density than the known comparison coupler (105). Furthermore, they absorb at longer wavelengths. Moreover, the secondary colour densities at 436 nm are lower in the case of the compounds of the formulae (101) and (102) (compound (101): the secondary colour density is 11% of the maximum density ($D_{max}$), compound (102): 10% of $D_{max}$; comparison coupler (105): 13% of $D_{max}$).

The advantageous values for $\lambda_{max}$, $D_{max}$ and the secondary colour density permit improved colour rendition when the colour couplers according to the invention are used in materials for colour photography.

What is claimed is:

1. A light-sensitive recording material for colour photography, which contains at least one magenta coupler in at least one silver halide emulsion layer, wherein the magenta coupler has the formula

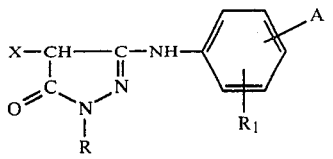

in which A is a 5-membered, heterocyclic, unsaturated ring system which contains 2 or 3 hetero-atoms, at least one of which is a nitrogen atom, and can be fused with a benzene ring and which is substituted by at least one ballast group, R is a substituted or unsubstituted aryl radical, $R_1$ is hydrogen, halogen, alkyl, alkoxy, halogenoalkyl, alkylsulfonyl or aryloxy and X is a radical detachable during the coupling reaction.

2. A recording material according to claim 1, wherein the magenta coupler has the formula

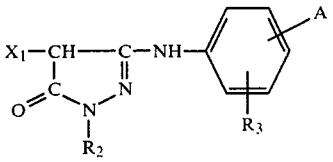

in which $R_2$ is phenyl, which is unsubstituted or substituted by halogen, substituted or unsubstituted alkyl or alkoxy, each having 1 to 5 carbon atoms, phenyl, trifluoromethyl, cyano, nitro, $—SO_2R_4$ or $—SO_2NR_5R_6$, $R_3$ is hydrogen, halogen, alkyl, halogenoalkyl, alkoxy or alkylsulfonyl, each having 1 to 5 carbon atoms, or phenoxy and $R_4$ is alkyl having 1 to 5 carbon atoms or substituted or unsubstituted phenyl, $R_5$ and $R_6$ are each hydrogen, alkyl having 1 to 5 carbon atoms or substituted or unsubstituted phenyl, $X_1$ is hydrogen, halogen, cyano, thiocyano, arylazo, aryloxy, acyloxy, acylamino or $R_7S$—, in which $R_7$ is alkyl having 5 to 10 carbon atoms, cycloalkyl having 5 or 6 carbon atoms, substituted or unsubstituted aryl or a substituted or unsubstituted heterocyclic radical, and A is as defined in claim 1.

3. A recording material according to claim 2, wherein the magenta coupler has the formula

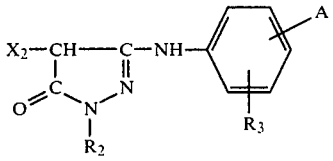

in which $X_2$ is hydrogen, halogen, cyano, thiocyano, phenylazo or naphthylazo which are unsubstituted or substituted by alkyl or alkoxy, each having 1 to 5 carbon atoms, halogen, alkylmercapto or acylamino, each having 1 to 7 carbon atoms, acyloxy having 1 to 22 carbon atoms or $R_8S$— and $R_8$ is alkyl having 5 to 10 carbon atoms, cycloalkyl having 5 or 6 carbon atoms, phenyl, naphthyl or a substituted or unsubstituted 5-membered or 6-membered heterocyclic ring which contains at least one nitrogen, oxygen or sulfur atom and preferably contains 1 to 4 nitrogen atoms, and $R_2$, $R_3$ and A are as defined in claim 2.

4. A recording material according to claim 3, wherein the magenta coupler has the formula

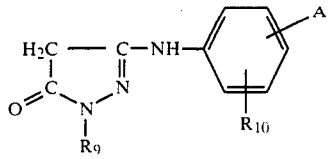

in which $R_9$ is phenyl which is unsubstituted or substituted by chlorine, methyl, methoxy, trifluoromethyl or cyano and $R_{10}$ is hydrogen, alkyl having 1 to 5 carbon atoms or halogen and A is as defined in claim 3.

5. A recording material according to claim 4, wherein the magenta coupler has the formula

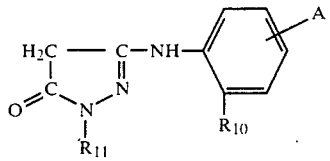

in which $R_{11}$ is 2,4,6-trichloro- or 2,6-dichloro-4-methoxy-phenyl and A and $R_{10}$ are as defined in claim 4.

6. A recording material according to claim 5, wherein the magenta coupler has the formula

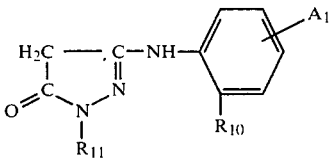

in which $A_1$ is a 5-membered, heterocyclic, unsaturated ring system which contains 2 or 3 nitrogen atoms or 1 or 2 nitrogen atoms and one oxygen atom or one sulfur atom and can be fused with a benzene ring and which is substituted by at least one ballast group and $R_{10}$ and $R_{11}$ are as defined in claim 5.

7. A recording material according to claim 6, wherein the magenta coupler has the formula

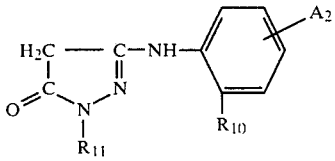

in which $A_2$ is a diazole, triazole, oxazole, thiazole, oxadiazole, thiadiazole, diazolone, triazolone, benzoxazole, benzthiazole or benzimidazole radical with at least one ballast group and, if desired, further substituents, and $R_{10}$ and $R_{11}$ are as defined in claim 6.

8. A recording material according to claim 7, wherein the further substituents are alkyl, alkoxy, hydroxyalkyl, halogenoalkyl or alkylmercapto, each having 1 to 4 carbon atoms, halogen, hydroxyl, carbalkoxy having 1 to 4 carbon atoms in the alkyl moiety, —CN, $—CONH_2$ and/or $—NHCOR_{12}$, in which $R_{12}$ is alkyl having 1 to 4 carbon atoms or alkoxyalkyl having 2 to 4 carbon atoms, and the ballast group is alkyl, alkoxy, cycloalkoxy, alkoxyalkyl, alkoxycycloalkyl, cycloalkoxyalkyl, aralkyl, phenoxyalkyl, which can be substituted by halogen or alkyl having 1 to 10 carbon atoms, alkyl- or dialkyl-aminoalkyl, substituted or unsubstituted aryl- or diaryl-aminoalkyl, alkylmercaptoalkyl or substituted or unsubstituted arylmercaptoalkyl, in which, in each case, the sum of the carbon atoms is 5 to 40; or also $-COOR_{13}$, $-COR_{13}$, $-NR_{13}R_{14}$, $-CONR_{13}R_{14}$, $-NR_{14}COR_{13}$, $-NR_{14}COR_{15}$, $-SO_2R_{13}$, $-SO_2NR_{13}R_{14}$ or $-NR_{14}SO_2R_{13}$, in which $R_{13}$ is alkyl having 5 to 40 carbon atoms or cycloalkyl having 5 to 12 carbon atoms, $R_{14}$ is hydrogen or alkyl having 1 to 12 carbon atoms and $R_{15}$ is alkoxyalkyl having 5 to 20 carbon atoms or phenoxyalkyl which has 1 to 12 carbon atoms in the alkyl moiety and can be substituted on the phenyl ring by alkyl having 1 to 10 carbon atoms.

9. A recording material according to claim 7 wherein the magenta coupler has the formula

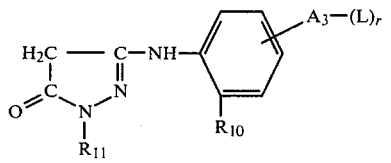

in which $A_3$ is a diazole, triazole, oxazole, thiazole, oxadiazole, thiadiazole, diazolone, triazolone, benzoxazole, benzthiazole or benzimidazole radical which is linked to the adjacent phenyl ring via a nitrogen or a carbon atom and can be substituted by alkyl, alkoxy, hydroxyalkyl, halogenoalkyl or alkylmercapto, each having 1 to 4 carbon atoms, halogen, hydroxyl, carbalkoxy having 1 to 4 carbon atoms in the alkoxy moiety, $-CONH_2$, —CN and/or $-NHCOR_{12}$, in which $R_{12}$ is alkyl having 1 to 4 carbon atoms or alkoxyalkyl having 2 to 4 carbon atoms, L is alkyl, alkoxy, alkoxyalkyl, phenylalkyl or phenoxyalkyl having 5 to 30 carbon atoms, or $-NHCOR_{13}$ or $-NR_{14}COR_{15}$ in which $R_{13}$ is alkyl having 5 to 40 carbon atoms or cycloalkyl having 5 to 12 carbon atoms, $R_{14}$ is hydrogen or alkyl having 1 to 12 carbon atoms and $R_{15}$ is alkoxyalkyl having 5 to 20 carbon atoms or phenoxyalkyl which has 1 to 22 carbon atoms in the alkyl moiety and can be substituted on the phenyl ring by alkyl having 1 to 10 carbon atoms, and r is 1 or 2 and $R_{10}$ and $R_{11}$ are as defined in claim 7.

10. A recording material according to claim 9, wherein the magenta coupler has the formula

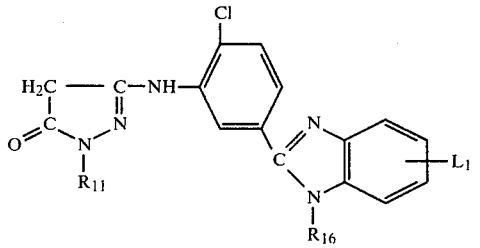

in which $R_{16}$ is hydrogen or alkyl or halogenoalkyl each having 1 to 4 carbon atoms and $L_1$ is alkyl, alkoxyalkyl, phenylalkyl or phenoxyalkyl having 8 to 30 carbon atoms and $R_{11}$ is as defined in claim 9.

11. A recording material according to claim 9, wherein the magenta coupler has the formula

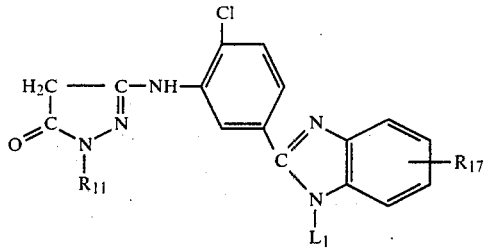

in which $R_{17}$ is hydrogen or alkyl, alkoxy or halogenoalkyl each having 1 to 4 carbon atoms, halogen, hydroxyl, cyano, $-CONH_2$ and/or carbalkoxy having 1 to 4 carbon atoms in the alkoxy moiety and $L_1$ is alkyl, alkoxyalkyl, phenylalkyl or phenoxyalkyl having 8 to 30 carbon atoms.

12. A recording material according to claim 9, wherein the magenta coupler has the formula

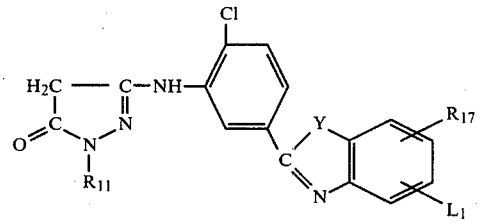

in which Y is —O— or —S—, $R_{17}$ is hydrogen or alkyl, alkoxy or halogenoalkyl each having 1 to 4 carbon atoms, halogen, hydroxyl, cyano, $-CONH_2$ and/or carbalkoxy having 1 to 4 carbon atoms in the alkoxy moiety and $L_1$ is alkyl, alkoxyalkyl, phenylalkyl or phenoxyalkyl having 8 to 30 carbon atoms, and $R_{11}$ is as defined in claim 9.

13. A recording material according to claim 9, wherein the magenta coupler has the formula

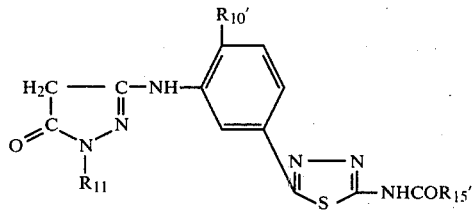

in which $R_{10}'$ is halogen or alkyl having 1 to 5 carbon atoms, $R_{15}'$ is phenoxyalkyl which has 1 to 14 carbon atoms in the alkyl moiety and is substituted on the phenyl ring by alkyl having 1 to 10 carbon atoms, and $R_{11}$ is as defined in claim 9.

14. A recording material according to claim 9, wherein $R_{11}$ is 2,4,6-trichlorophenyl.

15. A recording material according to claim 11, wherein $L_1$ is alkyl having 8 to 25 carbon atoms and $R_{17}$ is hydrogen.

16. A recording material according to claim 12, wherein $L_1$ is alkyl having 8 to 25 carbon atoms and $R_{17}$ is hydrogen.

17. A process, for colour photography, for the production of a magenta image by colour development of a recording material according to claim 1, which has been exposed image-wise.

18. The magenta images produced by the process according to claim 17.

* * * * *